US009838795B2

(12) United States Patent
Wang et al.

(10) Patent No.: US 9,838,795 B2
(45) Date of Patent: Dec. 5, 2017

(54) SPEAKER

(71) Applicants: Hongxing Wang, Shenzhen (CN); Lubin Mao, Shenzhen (CN); Shun Guo, Shenzhen (CN)

(72) Inventors: Hongxing Wang, Shenzhen (CN); Lubin Mao, Shenzhen (CN); Shun Guo, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/005,066

(22) Filed: Jan. 25, 2016

(65) Prior Publication Data

US 2016/0381463 A1 Dec. 29, 2016

(30) Foreign Application Priority Data

Jun. 23, 2015 (CN) ..... 2015 2 0435108 U

(51) Int. Cl.

| | |
|---|---|
| ***H04R 9/02*** | (2006.01) |
| ***H04R 9/04*** | (2006.01) |
| ***H04R 7/12*** | (2006.01) |
| ***H04R 9/06*** | (2006.01) |

(52) U.S. Cl.

CPC ..... *H04R 9/025* (2013.01); *H04R 7/127* (2013.01); *H04R 9/046* (2013.01); *H04R 9/06* (2013.01); *H04R 9/047* (2013.01); *H04R 2209/024* (2013.01); *H04R 2499/11* (2013.01)

(58) Field of Classification Search

CPC . H04R 9/025; H04R 9/06; H04R 9/08; H04R 9/047; H04R 2209/021; H04R 2209/022; H04R 2209/024; H04R 2499/11; H04R 2499/15

See application file for complete search history.

(56) References Cited

U.S. PATENT DOCUMENTS 3,699,249 A * 10/1972 Crane ..... H02K 41/0356 336/200
4,208,736 A * 6/1980 Babikyan ..... G01S 1/72 367/153
4,334,127 A * 6/1982 Shimada ..... H04R 9/025 335/306
4,544,805 A * 10/1985 Sawafuji ..... H04R 7/04 181/173
4,584,439 A * 4/1986 Paddock ..... H04R 9/063 381/403

(Continued)

*Primary Examiner* — Joshua Kaufman
(74) *Attorney, Agent, or Firm* — Na Xu; IPro, PLLC

(57) ABSTRACT

A speaker includes a vibration system including a vibrating diaphragm and a flat voice coil for driving the vibrating diaphragm; a magnetic circuit system including a first magnet group, a second magnet group and a third magnet group, lined up in turn along the vibration direction of the vibration system; and a housing for accommodating the vibrational system and the magnetic circuit system. The first magnet group includes a first magnet and the second magnet with opposite magnetic poles thereof faced each other. The second magnet group includes a third magnet and a fourth magnet with N-pole of the third magnet close to S-pole of the fourth magnet. The third magnet group includes a fifth magnet and a sixth magnet with opposite magnetic poles thereof faced each other.

7 Claims, 2 Drawing Sheets

(56) References Cited

U.S. PATENT DOCUMENTS 4,653,103 A * 3/1987 Mori ..... H04R 9/047 381/117
4,903,308 A * 2/1990 Paddock ..... H04R 7/02 181/153
5,003,609 A * 3/1991 Muraoka ..... H04R 9/047 381/117
5,003,610 A * 3/1991 Adachi ..... H04R 9/047 381/413
5,216,723 A * 6/1993 Froeschle ..... H04R 9/025 381/415
5,430,805 A * 7/1995 Stevenson ..... H04R 9/047 381/408
5,905,805 A * 5/1999 Hansen ..... H04R 9/06 381/398
6,208,237 B1 * 3/2001 Saiki ..... H04M 1/03 340/388.1
6,542,617 B1 * 4/2003 Fujihira ..... H04R 9/04 381/400
6,681,026 B2 * 1/2004 Kam ..... H04R 9/047 381/412
6,931,140 B2 * 8/2005 Van Halteren ..... H04R 9/063 181/173
6,973,194 B2 * 12/2005 Iwasa ..... H04R 9/025 381/401
7,227,970 B2 * 6/2007 Calderwood ..... H04R 9/025 381/412
7,254,248 B2 * 8/2007 Johannsen ..... H04M 1/03 381/409
7,333,620 B2 * 2/2008 Nguyen ..... H04R 7/045 381/152
7,412,065 B2 * 8/2008 Nguyen ..... H04R 9/06 381/152
7,450,729 B2 * 11/2008 Nguyen ..... H04R 9/025 381/152
8,155,371 B2 * 4/2012 Wu ..... H04R 9/045 381/396
8,391,515 B2 * 3/2013 Lu ..... H04R 19/02 381/150
8,542,864 B2 * 9/2013 Tanabe ..... H04R 9/043 381/386
8,699,745 B2 * 4/2014 Saiki ..... H04R 1/225 381/412
2002/0118847 A1 * 8/2002 Kam ..... H04R 7/045 381/111
2002/0118856 A1 * 8/2002 Croft, III ..... H04R 7/22 381/412
2002/0172392 A1 * 11/2002 Iwasa ..... H04R 9/025 381/413
2003/0103642 A1 * 6/2003 Kam ..... H04R 9/043 381/431
2004/0008101 A1 * 1/2004 Trandafir ..... H01F 7/066 335/229
2004/0086145 A1 * 5/2004 Stiles ..... H04R 9/025 381/412
2004/0086150 A1 * 5/2004 Stiles ..... H04R 9/025 381/421
2004/0131223 A1 * 7/2004 Stiles ..... H04R 9/025 381/412
2004/0136558 A1 * 7/2004 Usuki ..... H04R 9/025 381/394
2004/0156527 A1 * 8/2004 Stiles ..... H04R 9/063 381/412
2006/0251286 A1 * 11/2006 Stiles ..... H04R 9/025 381/421
2007/0140520 A1 * 6/2007 Konuma ..... H04R 7/127 381/400
2007/0140521 A1 * 6/2007 Mitobe ..... B06B 1/045 381/420
2007/0147651 A1 * 6/2007 Mitobe ..... H04R 9/025 381/396
2007/0160257 A1 * 7/2007 Stiles ..... H04R 9/025 381/421
2008/0205686 A1 * 8/2008 Tagami ..... H04R 9/025 381/398
2009/0028375 A1 * 1/2009 Richoux ..... H04R 9/025 381/412
2009/0257617 A1 * 10/2009 Ikeda ..... H04R 9/047 381/410
2010/0322458 A1 * 12/2010 Takewa ..... H04R 7/02 381/398
2011/0211725 A1 * 9/2011 Takewa ..... H04R 7/04 381/413
2012/0051580 A1 * 3/2012 Wei ..... H04R 9/025 381/400
2012/0163651 A1 * 6/2012 Zhang ..... H04R 9/025 381/407
2012/0170792 A1 * 7/2012 Li ..... H02K 33/16 381/412
2012/0177246 A1 * 7/2012 Shi ..... H01F 7/0289 381/398
2014/0072149 A1 * 3/2014 Yan ..... H04R 1/06 381/162
2015/0117699 A1 * 4/2015 Cai ..... H01F 7/0289 381/412
2016/0226359 A1 * 8/2016 Guo ..... H02K 33/16
2016/0381462 A1 * 12/2016 Wang ..... H04R 9/025 381/398
2016/0381463 A1 * 12/2016 Wang ..... H04R 9/046 381/400
2016/0381481 A1 * 12/2016 Wang ..... H04R 31/006 381/400

* cited by examiner

SPEAKER

FIELD OF THE INVENTION

The present disclosure relates to electro-acoustic transducers, more particularly to a speaker having a diaphragm driven by a voice coil.

DESCRIPTION OF RELATED ART

With the rapid development of technology, audio devices are more and more popular. The people require not only the audio playing function of the audio devices, but also require higher reliability of audio devices. As more mobile multimedia technologies are developed particularly in 3G era, many audio devices are provided with many entertainment features, such as video playback, digital camera, games, GPS navigation and so on, more sophisticated and compact electronic components are required in audio devices.

The speaker is a common electronic component in audio devices and is used mainly for playback of audio signals. In the existing audio devices, the thickness of mobile phone, for example, is smaller, so that the speaker shall be thinner also. If the speaker is too thin, the vibration amplitude of the vibrating diaphragm is reduced, that will affect seriously the low frequency performance of the speaker. Therefore, the existing long stroke speaker with better low frequency performance is developed and the thickness is small enough, so that such a speaker can solve well the problems of traditional speaker. The magnetic circuit system of the long stroke speaker includes usually two pairs of magnets separated each other as drive magnets. The voice coil of the vibration system moves in reciprocating mode in the magnet gap between the magnets. However, the magnetic flux leakage in the magnetic circuit system of the long stroke speaker is serious. The vibration amplitude of the voice coil is difficult to be controlled. The voice coil is easier to tear the vibrating diaphragm in larger vibration amplitude; and the sound quality is affected.

Therefore, it is necessary to provide a new speaker to overcome the problems mentioned above.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment. To make the technical problems to be solved, technical solutions and beneficial effects of present disclosure more apparent, the present disclosure is described in further detail together with the figures and the embodiment. It should be understood the specific embodiment described hereby is only to explain this disclosure, not intended to limit this disclosure.

Figure 1:
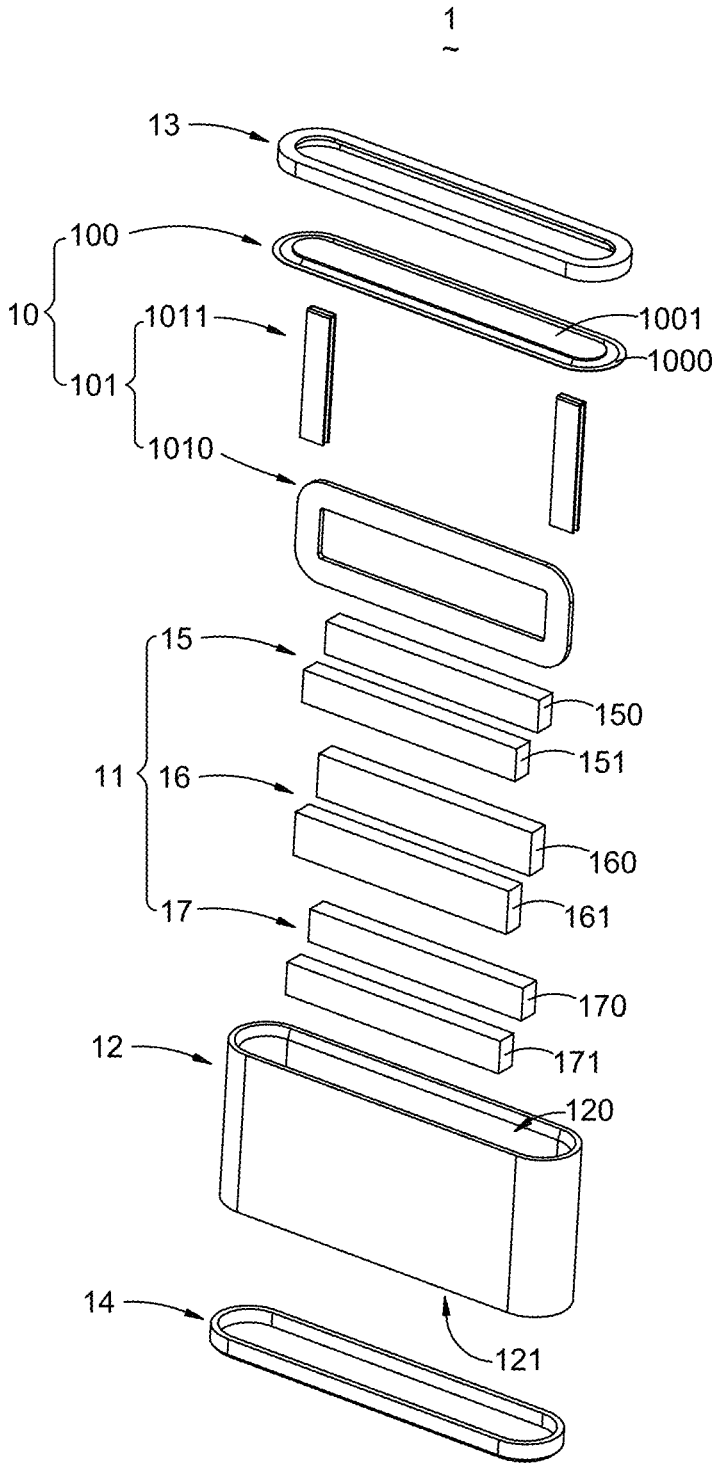
FIG. 1 is an isometric exploded view of a speaker in accordance with an exemplary embodiment of the present disclosure.
Figure 2:
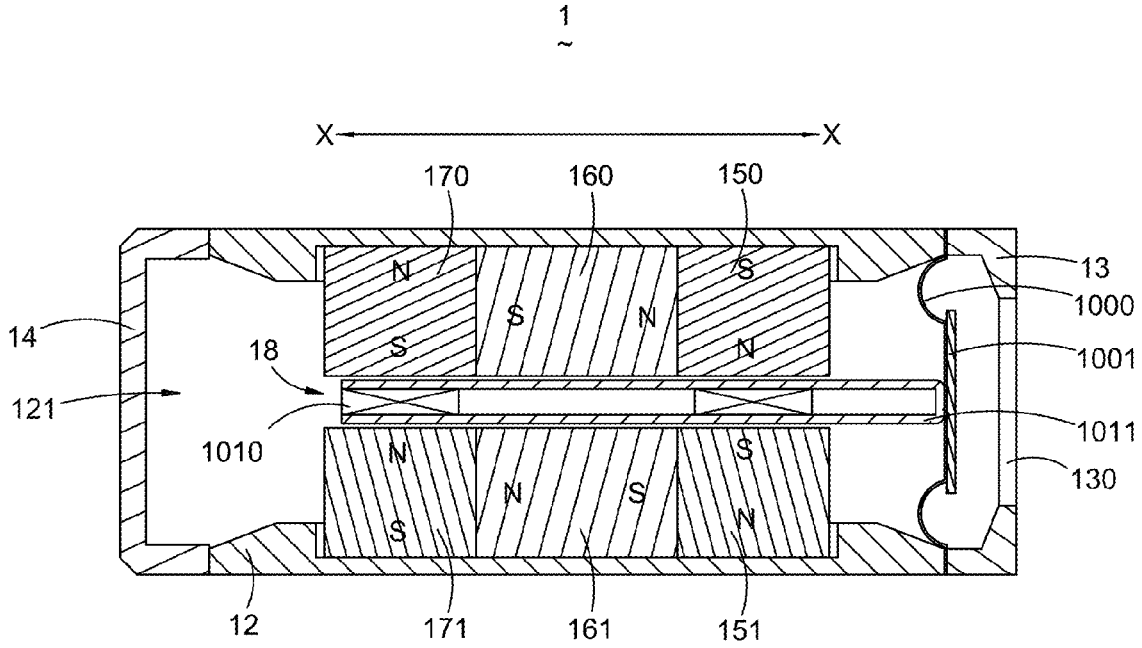
FIG. 2 is a cross-sectional view of the speaker in FIG. 1.

As shown in FIGS. 1 and 2, a speaker 1 in accordance with an exemplary embodiment of the present disclosure, includes a vibration system 10, a magnetic circuit system 11, a housing 12 for assembling the vibration system 10 and the magnetic circuit system 11, a front cover 13 and a rear cover 14 assembled on the housing 12 to create a space to accommodate the vibration system 10 and the magnetic circuit system 11.

The magnetic circuit system 11 includes a first magnet group 15, a second magnet group 16 and a third magnet group 17, which are lined up in turn along a vibration direction X-X of the vibration system 10. The first magnet group 15 and the third magnet group 17 may be attached with the second magnet group 16, or may be separated each other. In an optional embodiment, the first magnet group 15, the second magnet group 16, and the third magnet group 17 are fixed respectively on an inner surface of the housing 12. The second magnet group 16 is magnetized along the vibration direction X-X of the vibration system 10. The first magnet group 15 and the third magnet group 17 are magnetized along a direction vertical to the vibration direction X-X of the vibration system 10.

The first magnet group 15 includes a first magnet 150 and a second magnet 151, which are separated with their opposite magnetic poles faced each other. The second magnet group 16 includes a third magnet 160 and a fourth magnet 161, which are separated with their opposite magnetic poles faced each other. Two magnetic poles of the third magnet 160 and two magnetic poles of the fourth magnet 161 are close to each other respectively. N-pole of the third magnet 160 and S-pole of the fourth magnet 161 are separated and faced each other. S-pole of the third magnet 160 and N-pole of the fourth magnet 161 are separated and adjacent to each other. The third magnet group 17 includes a fifth magnet 170 and a sixth magnet 171, which are separated with their opposite magnetic poles faced each other. The gap between the first magnet 150 and the second magnet 151, the gap between the third magnet 160 and the fourth magnet 161, and the gap between the fifth magnet 170 and the sixth magnet 171 create cooperatively a magnetic gap 18.

The vibration system 10 includes a vibrating diaphragm 100 with its circumferential edge fixed on the housing 12 and a flat voice coil 101 which drives the vibrating diaphragm 100 to vibrate. One end of the voice coil is suspended in the magnetic gap 18. The flat voice coil 101 vibrates along its vibration direction X-X.

The third magnet 160 is located between the first magnet 150 and the fifth magnet 170. The fourth magnet 161 is located between the second magnet 151 and the sixth magnet 171. The magnetic pole of the first magnet 150 close to the second magnet 151 and the magnetic pole of the fifth magnet 170 close to the sixth magnet 171 are opposite to each other. As shown in FIG. 2, optionally, N-pole of the third magnet 160 is close to the first magnet 150. Accordingly, S-pole of the third magnet 160 is close to the fifth magnet 170. By virtue of the configuration, the flat voice coil 101 vibrates in reciprocating mode under force in the magnetic gap 18 between the first magnet 150 and the second magnet 151, as well as in the magnetic gap 18 between the fifth magnet 170 and the sixth magnet 171. When the voice coil 101 moves to the magnetic gap 18 between the third magnet 160 and the fourth magnet 161, because the magnetic field in opposite direction exerts an opposite force on the voice coil 101, the vibration amplitude of the voice coil 101 is limited. Not only that, the second magnet group 16 can play a role also to separate the first magnet group 15 and the third magnet group 17, so as to increase the magnetic flux density within the magnetic gap 18, and reduce the magnetic flux leakage of the third magnet group 15 and the third magnet group 17.

In an optional embodiment, the first magnet 150 and the second magnet 151 are in parallel. The third magnet 160 and the fourth magnet 161 are in parallel. The fifth magnet 170 and the sixth magnet 171 are in parallel.

The cross section of the housing 12 is in a runway tubular shape. The housing 12 includes a front opening 120 for assembling the vibrating diaphragm 100 and a rear opening 120 relative to the front opening 121. The front opening 120 and the rear opening 121 are connected. The front cover 13 is installed on the front opening 120. The circumferential edge of the vibrating diaphragm 100 is fixed between the front cover 13 and the housing 12. The rear cover 14 is installed on the rear opening 121. The front cover 13 is provided also a sound outlet 130. The sound from the vibrating diaphragm 100 is emitted from this sound outlet 130.

The vibrating diaphragm 100 includes a suspension 1000 with its circumferential edge fixed on the housing 12, and a center dome top 1001 connected to the suspension 1000. The flat voice coil 101 includes a voice coil wire 1010 in flat and annular shape and a coil bracket 1011 with one end fixed on the center dome top 1001. The voice coil wire 1010 is fixed on the voice coil bracket 1011.

In the speaker 1 disclosed above, the vibrating diaphragm 100 can have bigger vibration amplitude, so that the speaker 1 has a better low-frequency sound effect, in addition, the vibration amplitude of the voice coil 101 can be controlled effectively.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker, comprising:

a vibration system including a vibrating diaphragm and a flat voice coil for driving the vibrating diaphragm;

a magnetic circuit system including a first magnet group, a second magnet group and a third magnet group, lined up in turn along the vibration direction of the vibration system, the first magnet group magnetized along a direction perpendicular to the vibration direction of the vibration system including a first magnet and a second magnet with opposite magnetic poles thereof facing each other, the second magnet group magnetized along the vibration direction of the vibration system including a third magnet and a fourth magnet with N-pole of the third magnet close to S-pole of the fourth magnet; the third magnet group magnetized along a direction perpendicular to the vibration direction of the vibration system including a fifth magnet and a sixth magnet with opposite magnetic poles thereof facing each other, wherein the third magnet is located between the first magnet and the fifth magnet; the fourth magnet is located between the second magnet and the sixth magnet; the magnetic pole of the first magnet close to the second magnet and the magnetic pole of the fifth magnet close to the sixth magnet are opposite to each other;

a housing for accommodating the vibrational system and the magnetic circuit system;

a magnetic gap formed by the gap between the first magnet and the second magnet, the gap between the third magnet and the fourth magnet, and the gap between the fifth magnet and the sixth magnet, for partially receiving the flat voice coil.

2. The speaker according to claim 1, wherein the housing includes a front opening for assembling the vibrating diaphragm and a rear opening corresponding to and communicating with the front opening.

3. The speaker according to claim 2 further including a front cover for the front opening and a rear cover for the rear opening, and an edge of the vibrating diaphragm is fixed between the front cover and the housing.

4. The speaker according to claim 1, wherein the vibrating diaphragm includes a suspension with a periphery thereof fixed on the housing, and a center dome top connected to the suspension.

5. The speaker according to claim 4, wherein the flat voice coil includes a voice coil wire in flat and annular shape and a coil bracket with one end fixed on the center dome top.

6. The speaker according to claim 1, wherein the first magnet group, the second magnet group, and the third magnet group are fixed respectively on the inner surface of the housing.

7. The speaker according to claim 1, wherein the first magnet group, the second magnet group and the third magnet group are separated from each other.

* * * * *